US008956468B2

(12) United States Patent
Brouwer et al.

(10) Patent No.: US 8,956,468 B2
(45) Date of Patent: Feb. 17, 2015

(54) ZR-/TI-CONTAINING PHOSPHATING SOLUTION FOR PASSIVATION OF METAL COMPOSITE SURFACES

(75) Inventors: Jan-Willem Brouwer, Willich (DE); Jens Krömer, Düsseldorf (DE); Matthias Hamacher, Hürth (DE); Stephan Winkels, Mönchengladbach (DE); Frank-Oliver Pilarek, Köln (DE); Marc Balzer, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/423,558

(22) Filed: Mar. 19, 2012

(65) Prior Publication Data

US 2012/0177946 A1 Jul. 12, 2012

Related U.S. Application Data

(60) Division of application No. 12/427,785, filed on Apr. 22, 2009, and a continuation of application No. PCT/EP2007/059628, filed on Sep. 13, 2007.

(30) Foreign Application Priority Data

Nov. 8, 2006 (DE) ..... 10 2006 052919

(51) Int. Cl.
*C23C 22/12* (2006.01)
*C23C 22/07* (2006.01)

(52) U.S. Cl.
USPC ..... 148/247; 148/253; 106/14.11; 106/14.12

(58) Field of Classification Search
CPC ..... C23C 22/07; C23C 22/08; C23C 22/12; C23C 22/182; C23C 22/34; C23C 22/36; C23C 22/361; C23C 22/362
USPC ..... 148/247, 253; 106/14.11, 14.12
See application file for complete search history.

(56) References Cited

U.S. PATENT DOCUMENTS 5,863,357 A 1/1999 Shinomiya et al.
2005/0205166 A1 * 9/2005 Specht et al. ..... 148/262

FOREIGN PATENT DOCUMENTS

DE 10231279 B3 1/2004
DE 10322446 * 12/2004 ..... C23C 22/36

(Continued)

OTHER PUBLICATIONS

International Search Report dated Dec. 6, 2007, PCT International Application PCT/EP2007/059628 (All references cited in the International Search Report are listed above, unless previously cited by the Examiner).

*Primary Examiner* — Lois Zheng
(74) *Attorney, Agent, or Firm* — Mary K. Cameron

(57) ABSTRACT

The invention relates to an aqueous composition and to a method for the anticorrosion conversion treatment of metallic surfaces, particularly metallic materials which are assembled into composite structures, comprising steel or galvanized or alloy-galvanized steel and any combinations thereof, the composite structure being composed at least in part of aluminum or the alloys thereof. The aqueous composition according to the invention is based on a phosphating solution and contains, in addition to water-soluble compounds of zirconium and titanium, a quantity of free fluoride in a ratio that both permits phosphating of the steel and galvanized and/or alloy-galvanized steel surfaces and determines low pickling rates of the aluminum substrate with simultaneous passivation of the aluminum. The metallic materials, components and composite structures conversion treated in accordance with the underlying invention are used in automotive body construction, in shipbuilding, in construction and for the production of white goods.

14 Claims, 3 Drawing Sheets

(56) References Cited

FOREIGN PATENT DOCUMENTS

| | | | |
|---|---|---|---|
| WO | 9912661 | A1 | 3/1999 |
| WO | 02066702 | A1 | 8/2002 |
| WO | 02070782 | A2 | 9/2002 |
| WO | 2004104266 | A1 | 12/2004 |

* cited by examiner

ZR-/TI-CONTAINING PHOSPHATING SOLUTION FOR PASSIVATION OF METAL COMPOSITE SURFACES

This application is a divisional under 35 U.S.C. Section 120 of U.S. patent application Ser. No. 12/427,785, filed Apr. 22, 2009, which is a continuation under 35 U.S.C. Sections 365(c) and 120 of International Application No. PCT/EP2007/059628, filed Sep. 13, 2007 and published on May 15, 2008 as WO 2008/055726, which claims priority from German Patent Application No. 102006052919.7 filed Nov. 8, 2006, which are incorporated herein by reference in their entirety.

The present invention relates to an aqueous composition and to a method for the anticorrosion conversion treatment of metallic surfaces. The aqueous composition is particularly suitable for treating various metallic materials which are assembled in composite structures, inter alia of steel or galvanized or alloy-galvanized steel and any combinations of these materials, the composite structure being composed at least in part of aluminum or the alloys thereof. In the remainder of the text, mention of "aluminum" always includes alloys consisting of more than 50 atom % of aluminum. Depending on how the method is carried out, the metallic surfaces of the composite structure treated according to the invention may be coated in subsequent dip coating uniformly and with excellent adhesion properties, such that it is possible to dispense with post-passivation of the conversion-treated metallic surfaces. The clear advantage of the aqueous composition according to the invention for treating metallic surfaces consists in selectively coating different metal surfaces with a crystalline phosphate layer in the case of steel or galvanized or alloy-galvanized steel surfaces and with a noncrystalline conversion layer on the aluminum surfaces in such a manner that excellent passivation of the metallic surfaces and adequate coating adhesion for a subsequently applied coating are obtained. Using the aqueous composition according to the invention therefore enables a one-step process for the anticorrosion pretreatment of metal surfaces assembled into a composite structure.

In the field of automotive production which is of particular relevance to the present invention, increasing use is being made of different metallic materials assembled into composite structures. In body construction, use is predominantly made of many different steels due to their specific material properties, but increasing use is also made of light metals, which are of particular significance in terms of a considerable reduction in weight of the entire body. The average proportion of aluminum in an automotive body has risen in recent years from 6 kg in 1998 to 26 kg in 2002 and a further rise to approx. 50 kg is forecast for 2008, an amount which would correspond to a proportion by weight of approx. 10% of the unfinished body of a typical mid-range automobile. In order to take account of this development, it is appropriate to develop new approaches to body protection or to further develop existing methods and compositions for the anticorrosion treatment of the unfinished body.

In conventional phosphating baths, an accumulation of aluminum ions in the bath solution results in considerable impairment of the phosphating process, in particular of the quality of the conversion layer. A uniform crystalline phosphate layer is not formed on steel surfaces in the presence of trivalent cations of aluminum. Aluminum ions thus act as a bath poison in phosphating and, in the case of standard treatment of vehicle bodies which in part comprise aluminum surfaces, must be effectively masked by appropriate additives. Suitable masking of aluminum ions may be achieved by the addition of fluoride ions or fluoro complexes for example $SiF_6^{2-}$", as disclosed in U.S. Pat. No. 5,683,357. Depending on the strength of the pickling attack due to the additional input of fluoride ions, hexafluoroaluminates, for example in the form of cryolite, may be precipitated from the bath solution and make a significant contribution to sludge formation in the phosphating bath, so considerably complicating the phosphating process. Moreover, a phosphate layer is only formed on the aluminum surface at elevated pickling rates, thus at a relatively high concentration of free fluoride ions. Controlling defined bath parameters, in particular free fluoride content, is here of considerable significance to adequate anticorrosion protection and good coating adhesion. Inadequate phosphating of the aluminum surfaces always entails post-passivation in a subsequent processing step. In contrast, once priming is complete, visible blemishes caused by a non-uniformly deposited phosphate layer are in principle irreparable.

Joint phosphating of steel and/or galvanized steel components with aluminum components in a composite structure can thus be achieved only under certain conditions and subject to precise control of bath parameters and with appropriate post-passivation in further method steps. The associated technical control complexity may make it necessary to apportion and store fluoride-containing solutions in plant systems which are separate from the actual phosphating process. In addition, elevated maintenance and disposal costs for the precipitated hexafluoroaluminate salts reduce efficiency and have a negative impact on the overall balance-sheet for such a plant.

There is accordingly a requirement for improved pretreatment methods for complex components, such as for example automotive bodies, which, in addition to parts of aluminum, also contain parts made from steel and optionally galvanized steel. The intended outcome of the overall pretreatment is to produce on all the metal surfaces present a conversion layer or a passivation layer which is suitable as an anticorrosion substrate for coating, in particular before cathodic electro-dip coating.

The prior art discloses various two-stage pretreatment methods which take the common approach of depositing a crystalline phosphate layer onto the steel and optionally galvanized and alloy-galvanized steel surfaces in the first step and passivating the aluminum surfaces in a further subsequent step. These methods are disclosed in the publications WO99/12661 and WO02/066702. In principle, the method should be designed such that in a first step the steel or galvanized steel surfaces are selectively phosphated, this also being retained on post-passivation in a second method step, while no phosphate crystals are formed on the aluminum surfaces which can stand out from the coating material on subsequent dip coating. Such "crystal clusters" on the aluminum surfaces, which are enclosed in a subsequent priming coat, constitute irregularities in the coating, which not only disrupt the uniform visual appearance of the coated surfaces but may also cause local coating damage, and, as such, absolutely must be avoided.

The prior art, on which the present teaching builds, relates to a method which is described in German published patent application DE10322446 and achieves adequate selectivity in coating the various material surfaces, as previously discussed. DE10322446 makes use of conventional phosphating and complements this with water-soluble zirconium and/or titanium compounds, a specific quantity, but not in excess of 5000 ppm, of free fluoride being present. It may be inferred from the teaching of DE10322446 that such a zirconium- and/or titanium-containing phosphating solution used in the conversion treatment of metal surfaces which consist at least in part of aluminum, enables the deposition merely of a noncrystalline passivation layer onto the aluminum surfaces, the mass per unit area of any isolated phosphate crystals which are deposited amounting to no more than 0.5 g/m$^2$.

DE10322446 furthermore teaches that when phosphating solutions in which the total content of zirconium and/or titanium is in a range from 10 to 1000 ppm, preferably 50 to 250 ppm, are used, it is possible to dispense with post-passivation both of the phosphated metal surfaces and of the aluminum surfaces.

If the disclosed teaching of DE10322446 and the exemplary embodiments stated therein are followed, the single-stage process of a conversion treatment of metallic surfaces which comprise at least in part aluminum surfaces is carried out at constantly elevated fluoride contents, which entails an elevated pickling rate and thus a huge input of aluminum ions into the bath solution. There is a need to overcome the associated technical complexity in bath control and working up which inevitably arises from elevated sludge formation in the phosphating bath. Furthermore, settled out aluminate particles may remain behind on components conversion-treated in this manner which, after deposition of the coating primer, have a negative impact on the visual appearance of the coated components or also impair the coating adhesion and mechanical resistance of the coating.

BRIEF SUMMARY OF THE INVENTION

An aqueous composition for the anticorrosion conversion treatment of metallic surfaces, which comprises surfaces of steel or galvanized steel or alloy-galvanized steel or aluminum and any combinations thereof, is provided which contains (a) 5-50 g/l phosphate ions, (b) 0.3-3 g/l zinc(II) ions, (c) in total 1-200 ppm of one or more water-soluble compounds of zirconium and/or titanium relative to the element zirconium and/or titanium, wherein a quantity of free fluoride of 1-400 ppm, measured with a fluoride-sensitive electrode, is additionally present in the aqueous composition.

In one embodiment, an aqueous composition is provided wherein the quotient λ corresponding to the formula (I)

$$\lambda = \frac{F/mM}{\sqrt{Me/mM}} \quad (I)$$

F/mM and Me/mM respectively denoting the free fluoride (F) concentration and zirconium and/or titanium concentration (Me), in each case reduced by (meaning divided by) the unit of concentration in mM, does not fall below a specific value and this value, for an aqueous composition solely containing zirconium as component (c), is at least 4 or, in the case of an aqueous composition solely containing titanium as component (c), is at least 6, while, for an aqueous composition containing both components (c), the quotient λ according to formula (I) is no less than $$\frac{Zr/mM}{Zr/mM + Ti/mM} \cdot 4 + \frac{Ti/mM}{Zr/mM + Ti/mM} \cdot 6.$$

In one embodiment, an aqueous composition is provided wherein the quotient λ corresponding to the formula (I) for those compositions which, as component (c) solely contain water-soluble compounds of (i) zirconium, is at least 4, preferably at least 4.5 and particularly preferably at least 5, but no more than 10 and preferably no more than 8;

(ii) titanium, is at least 6, preferably at least 6.5 and particularly preferably at least 7, but no more than 14 and preferably no more than 12;

(iii) both zirconium and titanium, is no greater than $$\frac{Zr/mM}{Zr/mM + Ti/mM} \cdot 10 + \frac{Ti/mM}{Zr/mM + Ti/mM} \cdot 14$$

In another aspect of the invention, a method for the anticorrosion conversion treatment of metallic surfaces which, in addition to surfaces of steel and/or galvanized steel and/or alloy-galvanized steel, also comprise surfaces of aluminum, is provided wherein cleaned and degreased metallic surfaces are brought into contact with an aqueous composition as disclosed herein.

In one embodiment of the method, the metallic surfaces treated in this manner, an uninterrupted crystalline phosphate layer with an elemental loading of 0.5-4.5 g/m$^2$ being present on the steel, galvanized steel and alloy-galvanized steel surfaces and a noncrystalline conversion layer being present on the aluminum surfaces, are coated in a further method step, with or without intermediate rinsing with water, with an electro-dipcoating.

In one embodiment of the method, the aqueous composition according to the invention exhibits a free acid content of 0 points, preferably at least 0.5, particularly preferably at least 1, but no more than 3 points, preferably no more than 2 and particularly preferably no more than 1.5 points and a total acid content of at least 20 points, preferably at least 22 points, but no more than 26 and preferably no more than 24 points, a temperature of the aqueous composition being maintained in the range from 20 to 65° C.

In one embodiment of the method, the aqueous composition according to the invention exhibits a pH value of no less than 2.2, preferably no less than 2.4, and particularly preferably no less than 2.6, but no greater than 3.8, preferably no greater than 3.6 and particularly preferably no greater than 3.2, a temperature in the range from 20 to 65° C. being maintained.

In one embodiment of the method, passivating post-rinsing is not carried out once the metallic surfaces have been brought into contact with an aqueous composition according to the invention.

Alternatively, passivating post-rinsing, with or without intermediate rinsing with water, takes place once the metallic surfaces have been brought into contact with an aqueous composition according to the invention. In one embodiment, the passivating post-rinsing exhibits a pH value in the range from 3.5 to 5.5 and contains in total 200 to 1500 ppm of fluoro complexes of zirconium and/or titanium relative to the elements zirconium and/or titanium and optionally 10 to 100 ppm of copper(II) ions.

In another aspect of the invention, a metallic component containing steel and/or galvanized and/or alloy-galvanized steel surfaces and at least one aluminum surface, wherein, if present, both the steel and the galvanized and alloy-galvanized steel surfaces are coated with an uninterrupted crystalline phosphate layer with a layer weight of 0.5 to 4.5 g/m$^2$, while a noncrystalline conversion layer is formed on the aluminum surface is provided. In one embodiment, the metallic component was pretreated may a method according to the invention.

In another aspect of the invention, a metallic component treated according to the invention is included in a bodywork construction in automotive manufacture, in shipbuilding, in the construction industry and for the production of white goods.

DETAILED DESCRIPTION

Figure 1:
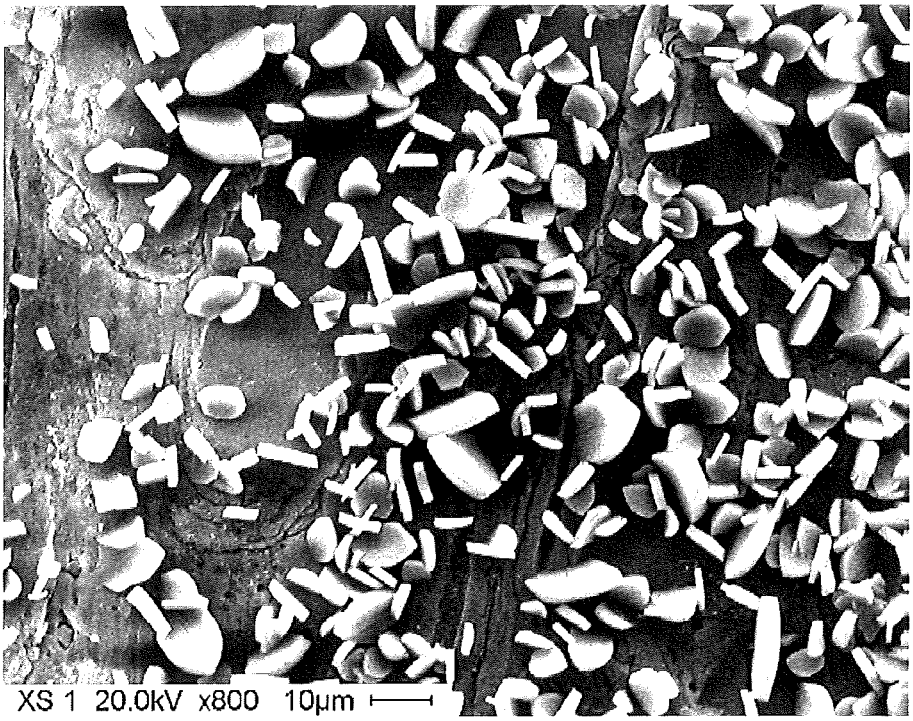
FIG. 1 shows a scanning electron microscope (SEM) micrograph of an aluminum sheet (AC120) conversion-treated in an aqueous composition at a content of free fluoride of 55 ppm, a zirconium content of 0 ppm and a λ value that is not defined.

The object of the present invention is accordingly to identify those conditions under which a bath solution based on the teaching of DE10322446 is suitable for conversion treatment of metallic surfaces assembled in a composite structure, which surfaces, in addition to steel and galvanized steel surfaces, at least in part comprise aluminum surfaces for producing a uniform continuous conversion layer on all surfaces which permits immediately subsequent coating with an organic dip coating without intermediate post-passivation and overcomes the above-stated technical problems caused by excessive pickling rates.

The present invention therefore relates to an aqueous composition for the anticorrosion conversion treatment of metallic surfaces, which comprises surfaces of steel or galvanized steel or alloy-galvanized steel or aluminum and any combinations thereof, which composition contains (a) 5-50 g/l phosphate ions, (b) 0.3-3 g/l zinc(II) ions, (c) in total 1-200 ppm of one or more water-soluble compounds of zirconium and/or titanium relative to the element zirconium and/or titanium, wherein a quantity of free fluoride of 1-400 ppm, measured with a fluoride-sensitive electrode, is additionally present in the aqueous composition.

In order to ensure in this bath composition a minimum pickling rate, which is in particular determined by the proportion of free fluoride ions, and simultaneously selective phosphating of the steel and/or galvanized and/or alloy-galvanized steel surfaces, the aluminum surfaces merely receiving a noncrystalline zirconium- and/or titanium-based passivation layer, the concentration of the free fluoride ions should not be optimized independently of the concentration of the zirconium and/or titanium compound.

It has proved possible according to the invention to identify a quotient λ corresponding to the formula (I) below which is characteristic of the passivation properties of the aqueous composition:

$$\lambda = \frac{F/mM}{\sqrt{Me/mM}}, \tag{I}$$

F/mM and Me/mM respectively denoting the free fluoride (F) concentration and zirconium and/or titanium concentration (Me), in each case reduced by the unit of concentration in mM ($10^{-3}$ mol/l). For purposes of this application "reduced by" means "divided by" the unit of concentration. For an aqueous composition of the underlying invention which contains solely zirconium as component (c), the quotient λ should be at least 4 or, in the case of an aqueous composition containing solely titanium as component (c), at least 6. For aqueous compositions which according to the invention contain both components (c), thus zirconium and titanium compounds, the quotient λ according to the formula (I) should be no less than $$\frac{Zr/mM}{Zr/mM + Ti/mM} \cdot 4 + \frac{Ti/mM}{Zr/mM + Ti/mM} \cdot 6.$$

If the quotient falls below these minimum values specified according to the invention, formation of the conversion layer on the steel and/or galvanized steel surfaces is displaced in favor of zirconium- and/or titanium-based passivation and deposition of uniform and continuous phosphate layers is no longer ensured. Conversely, increasing λ values are synonymous with an increasing pickling rate, which in turn favors phosphating of the aluminum surfaces and "crystal clusters" may form which are undesirable with regard to the subsequent priming coat.

Optimum ranges for the quotient λ, at which uniform passivation of all metal surfaces for the purposes of the invention is achieved, and an acceptable pickling rate is maintained and thus an acceptable input of aluminum ions into the bath solution occurs, are as follows:

According to the invention, the quotient λ for aqueous compositions containing as component (c) solely water-soluble compounds of (i) zirconium should be at least 4, preferably at least 4.5 and particularly preferably at least 5, but no more than 10 and preferably no more than 8;

(ii) titanium should be at least 6, preferably at least 6.5 and particularly preferably at least 7, but no more than 14 and preferably no more than 12;

(iii) both zirconium and titanium, should be no greater than $$\frac{Zr/mM}{Zr/mM + Ti/mM} \cdot 10 + \frac{Ti/mM}{Zr/mM + Ti/mM} \cdot 14$$

The proportion of free fluoride in the aqueous composition according to the invention is here determined potentiometrically with the assistance of a fluoride-sensitive glass electrode. A detailed description of the measurement method, calibration and method for determining the free fluoride concentration is provided in the description of the exemplary embodiments of the present invention.

The use of zirconium compounds in the various embodiments of the present invention provides technically better results than the use of titanium compounds and is therefore preferred. For example, complex fluoro acids or the salts thereof may be used.

The aqueous composition according to the invention for anticorrosion conversion treatment may in addition to the following:

0.3 to 3 g/l, Zn(II) and 5 to 40 g/l, phosphate ions and 1 to 200 ppm, of one or more water-soluble compounds of zirconium and/or titanium relative to the element zirconium and/or titanium also contain at least one of the following accelerators:

0.3 to 4 g/l, chlorate ions,
0.01 to 0.2 g/l, nitrite ions,
0.05 to 4 g/l, nitroguanidine,
0.05 to 4 g/l, N-methylmorpholine N-oxide,
0.2 to 2 g/l, m-nitrobenzenesulfonate ions,
0.05 to 2 g/l, m-nitrobenzoate ions,
0.05 to 2 g/l, p-nitrophenol,
1 to 150 mg/l, hydrogen peroxide in free or bound form,
0.1 to 10 g/l, hydroxylamine in free or bound form,
0.1 to 10 g/l, reducing sugar.

Such accelerators are familiar in the prior art as components of phosphating baths and perform the function of "hydrogen scavengers" by immediately oxidizing the hydrogen arising from acid attack on the metallic surface and, in so doing, are themselves reduced. The accelerator, which reduces the evolution of gaseous hydrogen on the metal surface, substantially facilitates the formation of a uniform crystalline zinc phosphate layer.

Experience has shown that the anticorrosion protection and coating adhesion of the crystalline zinc phosphate layers produced with an aqueous composition according to the invention are improved if one or more of the following cations is/are additionally present:

0.001 to 4 g/l, manganese(II),
0.001 to 4 g/l, nickel(II),
0.001 to 4 g/l, cobalt(II)
0.002 to 0.2 g/l, copper(II),
0.2 to 2.5 g/l, magnesium(II),
0.2 to 2.5 g/l, calcium(II),
0.01 to 0.5 g/l, iron(II),
0.2 to 1.5 g/l, lithium(I),
0.02 to 0.8 g/l, tungsten(VI).

The zinc concentration is preferably in the range between approx. 0.3 and approx. 2 g/l and in particular between approx. 0.8 and approx. 1.4 g/l. Higher zinc contents do not generate any significant advantages for conversion treatment with the aqueous composition according to the invention, but do give rise to increased levels of sludge in the treatment bath. Elevated zinc contents may, however, occur in an operating treatment bath if primarily galvanized surfaces are being phosphated and additional zinc thus gets into the treatment bath due to surface removal by pickling. Aqueous compositions for conversion treatment which, in addition to zinc ions, contain both manganese and nickel ions, are known to a skilled person in the field of phosphating as tri-cation phosphating solutions and are also highly suitable for the purposes of the present invention. A proportion of up to 3 g/l of nitrate, as conventional in phosphating, also facilitates the formation of a crystalline uniform and continuous phosphate layer on the steel, galvanized and alloy-galvanized steel surfaces.

In addition, hexafluorosilicate anions may be added to the aqueous composition for anticorrosion conversion treatment, since these are capable of complexing the trivalent ion aluminum cations introduced into the bath solution, such that phosphating is optimized and "speckling" on galvanized substrates is prevented, speckling being a locally increased pickling rate occurring on the surface associated with the deposition of amorphous, white zinc phosphate.

Another important parameter of the aqueous composition for the conversion treatment according to the invention is its free acid and total acid content. Free acid and total acid are important control parameters for phosphating baths since they are a measure of the pickling attack of the acid and the buffer capacity of the treatment solution and have a correspondingly major influence on the achievable layer weight. For the underlying invention, the aqueous treatment solution preferably has a free acid content, in each case ranked by increasing preference, of at least 0; 0.2; 0.5; 0.8; 1 point(s) but no more than 3; 2.5; 2; 1.5 points. A total acid content of the treatment solution, in each case ranked by increasing preference, of at least 20; 21; 22 points, but no more than 26; 25; 24 points should be present in this case. The term "free acid" is familiar to a skilled person in the field of phosphating. The specific determination method for the present invention for establishing the free acid and total acid content is stated in the Examples section. The pH value of the aqueous treatment solution is here, in each case with increasing preference, preferably no less than 2.2; 2.4; 2.6; 2.8 but also no greater than 3.6; 3.5; 3.4; 3.3; 3.2.

Application of the aqueous composition according to the invention for the conversion treatment of composite structures assembled from metallic materials which at least in part also comprise aluminum surfaces proceeds after cleaning and degreasing of the surfaces by bringing the surfaces into contact with the aqueous composition according to the invention, for example by spraying or dipping, at bath temperatures in the range from 20-65° C. for a time interval tailored to convection conditions in the bath plant and typical of the composition of the composite structure to be treated. Such dipping is conventionally immediately followed by a rinsing operation with mains water or deionized water, it being possible, after working up the rinsing water enriched with components of the treatment solution, to recirculate some rinsing water components into the bath solution according to the invention. With or without this rinsing step, the metallic surfaces of the composite structure treated in this manner may be provided in a further step with a priming coat, preferably with an organic electro-dip coating.

As an alternative to this single step method for the conversion treatment of metallic material surfaces in a composite structure with the treatment solution according to the invention, it is possible in a further step with or without an intermediate rinsing operation to carry out post-passivation of the phosphated and/or passivated metal surfaces with an aqueous composition which contains at least 200 to 1500 ppm of fluoro complexes of zirconium and/or titanium relative to the elements zirconium and/or titanium and optionally 10 to 100 ppm of copper(II) ions. The pH value of such a post-passivation solution is in the range from 3.5 to 5.5.

A composite structure assembled inter alia from steel and/or galvanized and/or alloy-galvanized steel components and aluminum components and conversion-treated according to this method comprises on its metallic surfaces, on which a crystalline zinc phosphate layer was formed, phosphating layer weights of 0.5 to 4.5 g/m$^2$.

The metallic surfaces which may be treated with the aqueous composition according to the invention to form a conversion layer are preferably steel, galvanized steel and alloy-galvanized steel together with aluminum and alloys of aluminum with an alloy content of less than 50 atom %, further alloy constituents which may be considered being silicon, magnesium, copper, manganese, zinc, chromium, titanium and nickel. The metallic surface may either consist solely of one metallic material or be assembled from any desired combination of the stated materials in a composite structure.

The metallic materials, components and composite structures conversion treated in accordance with the underlying invention are used in automotive body construction, in shipbuilding, in construction and for the production of white goods.

EXAMPLES

The aqueous composition according to the invention and the corresponding processing sequence for the conversion treatment of metallic surfaces was tested on metal test sheets of cold-rolled steel (CRS ST1405, from Sidca), hot-dip galvanized steel (HDG, from Thyssen) and aluminum (AC120).

The processing sequence for the treatment according to the invention of the metal test sheets, as is in principle also conventional in automotive body production, is shown in Table 1. The metal sheets are pretreated by alkaline cleaning and degreasing and, after a rinsing operation, are prepared for the conversion treatment according to the invention with an activating solution containing titanium phosphate. Conventional commercial products manufactured by the applicant are used for this purpose: Ridoline® 1569 A, Ridosol® 1270, Fixodine® 50 CF.

The free acid point number is determined by diluting a 10 ml bath sample to 50 ml and titrating it with 0.1 N sodium hydroxide solution to a pH value of 3.6. The consumption of sodium hydroxide solution in ml is the point number. Total acid content is determined correspondingly by titrating to a pH value of 8.5.

The content of free fluoride in the aqueous composition according to the invention for conversion treatment is established with the assistance of a potentiometric membrane electrode (inoLab pH/IonLevel 3, from WTW). The membrane electrode contains a fluoride-sensitive glass electrode (F501, from WTW) and a reference electrode (R503, from WTW). Two-point calibration is performed by dipping the two electrodes together in succession into calibration solutions with a content of 100 ppm and 1000 ppm prepared from Titrisol® fluoride standard from Merck without added buffer. The resultant measured values are correlated with the respective fluoride-content "100" or "1000" and input into the measuring instrument. The sensitivity of the glass electrode is then displayed on the measuring instrument in mV per decade of fluoride ion content in ppm, meaning mV/log($F^-$ in ppm), and is typically between −55 and −60 mV. Fluoride content in ppm may then be determined directly by dipping the two electrodes into the bath solution according to the invention, which has however been cooled.

Table 2 sets out the pickling rates for the substrate aluminum as a function of the concentration of free fluoride and zirconium for a processing sequence according to Table 1. As anticipated, the pickling rate here rises with each increase in fluoride concentration. Surprisingly, the pickling rate on aluminum is distinctly reduced by the addition of 50 ppm and, in the case of a concentration of free fluoride of 30 and 55 ppm, the pickling rate is reduced by 50% in comparison with an aqueous composition for conversion treatment which contains no zirconium.

TABLE 2

Pickling rate in g/m$^2$ on aluminum (AC 120) as a function of concentration of zirconium and free fluoride in the aqueous composition according to the invention

| Zirconium concentration, Zr/ppm | Free fluoride concentration, F/ppm | | | |
|---|---|---|---|---|
| | 30 | 55 | 80 | 100 |
| 0 | 0.90 | 1.03 | - | 1.17 |
| 10 | 0.95 | 1.07 | - | 1.20 |
| 20 | 0.79% | 1.00 | 1.03 | 1.06 |
| 30 | 0.58% | 0.80 | 0.88 | 0.95 |
| 40 | 0.47% | 0.62 | 0.73 | 0.85 |
| 50 | 0.44% | 0.50% | - | 0.75 |

%In the case of these combinations of concentrations of free fluoride zirconium, the λ value is below 4

Pickling rate determined by differential weighing of the cleaned and degreased substrates relative to the substrate conversion-treated according to Table 1 after removal of the conversion layer in aqueous 65 wt. % $HNO_3$ at 25° C. for 15 min At the same time, as is apparent from Table 3, conversion of the aluminum surface can be shifted from pure phosphating in favor of a zirconium-based passivation by a gradual increase in zirconium concentration. At a concentration of 55 ppm of

TABLE 1

Course of conversion treatment method for aluminum (AC 120), CRS ST1405 (Sidca) and HDG (Thyssen)

| Method steps | 1. Alkaline cleaning | 2. Rinsing operation | 3. Activation | 4. Phosphating | | 5. Rinsing operation | 6. Drying |
|---|---|---|---|---|---|---|---|
| Formulation | 4.0% Ridoline 1569 A 0.2% Ridosol 1270 | Deionized water* (κ < 1 μScm$^{-1}$) | 0.08% Fixodine 50 CF in deionized water | Zn: | 1.1 g/l | Deionized water* (κ < 1 μScm$^{-1}$) | Compressed air drying, then drying cabinet* |
| | | | | Mn: | 1.1 g/l | | |
| | | | | Ni: | 1.0 g/l | | |
| | | | | Zr: | 0-50 ppm | | |
| | | | | $PO_4$: | 15.7 ppm | | |
| | | | | $NO_3$: | 2.1 g/l | | |
| | | | | $SiF_6$: | 0.5 g/l | | |
| | | | | Free F: | 30-100 ppm | | |
| | | | | $NO_2$: | approx. 100 ppm | | |
| pH value | 10.8 | | | FA (pH 3.6): | 1.1 | | |
| | | | | TA (pH 8.5): | 22.0 | | |
| Temperature | 58° C. | approx. 20° C. | approx. 20° C. | | 51° C. | approx. 20° C. | *50° C. |
| Treatment time | 4 minutes | 1 min | 45 seconds | | 3 minutes | 1 min | *60 min |

FA (pH 3.6)/TA (pH 8.5):

Free acid/total acid stated in acid points corresponding to the consumption of 0.1N sodium hydroxide solution in ml to achieve a pH value of 3.6 (FA) or 8.5 (TA) in a bath sample of a volume of 10 ml diluted 1:5

*In the industrial process, deionized water is in fact also introduced for the rinsing operation, but this is partially recirculated and constantly worked up for this purpose. A certain degree of salt build-up is tolerated, such that for process engineering reasons specific conductance values of greater than 1 μScm$^{-1}$ are usual for the rinsing water.

free fluoride, just 10 ppm of zirconium are sufficient virtually completely to suppress the formation of a crystalline zinc phosphate layer on the aluminum surface, which layer does not however cover the surface either uniformly nor continuously. It may furthermore be inferred from Table 3 that uniform and continuous zinc phosphate layers are only formed on aluminum from free fluoride contents of roughly 100 ppm and in completely zirconium-free treatment solutions, it being necessary to accept an elevated pickling rate of the aluminum substrate (Table 2).

TABLE 3

Layer weight in g/m$^2$ on aluminum (AC 120) as a function of the concentration of zirconium and free fluoride in the aqueous composition according to the invention

| Zirconium concentration Zr/ppm | Free fluoride concentration, F/ppm | | | |
|---|---|---|---|---|
| | 30 | 55 | 80 | 100 |
| 0 | 2.20<br>ZPh not OK | 3.00/<1.5*<br>ZPh not OK | - | 3.80<br>ZPh OK |
| 10 | 0.32<br>P OK | 0.40/12.0*<br>P OK | - | 0.74<br>P OK |
| 20 | 0.32%<br>P OK | 0.40/27.9*<br>P OK | 0.45<br>P OK | 0.48<br>P OK |
| 30 | 0.33%<br>P OK | 0.47/37.0*<br>P OK | 0.53<br>P OK | 0.56<br>P OK |
| 40 | 0.27%<br>P OK | 0.39/44.0*<br>P OK | 0.49<br>P OK | 0.62<br>P OK |
| 50 | 0.33%<br>P OK | 0.37%/37.0<br>P OK | - | 0.60<br>P OK |

*Zirconium loading in g/m$^2$ measured by X-ray fluorescence analysis (XFA) on metal sheets which were coated at a free fluoride content of 55 ppm and a zirconium content of 0-55 ppm coated.

%In the case of these combinations of concentrations of free fluoride and zirconium, the λ value is below 4

ZPh: zinc phosphate layer

P: passivation layer

Not OK/OK rated by visual assessment of degree of coverage

Layer weight deteremined by differential weighing of the substrate conversion-treated according to Table 1 relative to the substrate after removal of the conversion layer in aqueous 65 wt. % $HNO_3$ at 25° C. for 15 min Corresponding investigations into the conversion treatment according to the invention on cold-rolled steel (Table 4) show that, at free fluoride contents of above 55 ppm, zirconium contents of up to 50 ppm do not have a disadvantageous impact on zinc phosphating. Conversely, on the basis of the layer weights and a visual assessment of layer quality, it is evident that at low fluoride concentrations the phosphating process is suppressed and a zirconium-based passivation layer is obtained on the steel surface. It has surprisingly been found that this is in particular the case when the quotient λ falls below a value of 4.

TABLE 4

Layer weight in g/m$^2$ on CRS ST1405 (Sidca-Stahl) as a function of the concentration of zirconium and free fluoride in the aqueous composition according to the invention

| Zirconium concentration Zr/ppm | Free fluoride concentration, F/ppm | | | |
|---|---|---|---|---|
| | 30 | 55 | 80 | 100 |
| 0 | 2.6<br>ZPh OK | - | - | - |
| 10 | 3.8<br>ZPh, OK | - | - | - |
| 20 | 0.1%<br>P not OK | 3.2<br>ZPh OK | 2.6<br>ZPh OK | 2.6<br>ZPh OK |
| 30 | 0.1%<br>P not OK | 3.3<br>ZPh OK | 2.4<br>ZPh OK | 2.4<br>ZPh OK |
| 40 | 0.2%<br>P not OK | 3.1<br>ZPh OK | 2.5<br>ZPh OK | 2.4<br>ZPh OK |
| 50 | 0.2%<br>P not OK | - | - | 2.9<br>ZPh OK |

%In the case of these combinations of concentrations of free fluoride and zirconium, the λ value is below 4

ZPh: zinc phosphate layer

P: passivation layer

Not OK/OK rated by visual assessment of degree of coverage, a passivation on the steel substrate per se being classed as "not OK" for the purposes of the invention.

Layer weight determined by differential weighing of the substrate conversion-treated according to Table 1 relative to the substrate after removal of the conversion layer in aqueous 5 wt. % $CrO_3$ at 70° C. for 15 min Similar results are obtained for conversion treatment of hot-dip galvanized steel surfaces (Table 5). Here too, the zinc phosphating is gradually replaced with a zirconium-based passivation by the increase in zirconium concentration at a constant free fluoride content, on this substrate too, the critical bath parameter for this changeover in the type of passivation being characterized by a λ value of below 4. Excessive layer weights of the zinc phosphate layer of >4.5 g/m$^2$ are indicative of a low barrier action of the phosphate layer, while characterizing the transition from zinc phosphating with desired crystallinity to pure Zr-based passivation at a falling λ value.

TABLE 5

Layer weight in g/m$^2$ on HDG (Thyssen) as a function of the concentration of zirconium and free fluoride in the aqueous composition according to the invention

| Zirconium concentration Zr/ppm | Free fluoride concentration, F/ppm | | | |
|---|---|---|---|---|
| | 30 | 55 | 80 | 100 |
| 0 | 2.2<br>ZPh OK | - | - | - |
| 10 | 3.2<br>ZPh, OK | - | - | - |
| 20 | 4.8%<br>ZPh not OK | 3.8<br>ZPh OK | 3.7<br>ZPh OK | 3.1<br>ZPh OK |
| 30 | 1.0%<br>P not OK | 4.0<br>ZPh OK | 3.8<br>ZPh OK | 3.0<br>ZPh OK |
| 40 | 0.9%<br>P not OK | 3.8<br>ZPh OK | 3.7<br>ZPh OK | 3.3<br>ZPh OK |
| 50 | 0.8%<br>P not OK | - | - | 2.5<br>ZPh OK |

%In the case of these combinations of concentrations of free fluoride and zirconium, the λ value is below 4

ZPh: zinc phosphate layer and P: passivation layer

TABLE 5-continued

Not OK/OK rated by visual assessment of degree of coverage, a passivation on the HDG substrate per se being classed as "not OK" for the purposes of the invention. Layer weight determined by differential weighing of the substrate conversion-treated according to Table 1 relative to the substrate after removal of the conversion layer in aqueous 5 wt. % $CrO_3$ at 25° C. for 5 min The fact that the addition of zirconium compounds suppresses phosphating of aluminum surfaces may also be demonstrated by electron micrographs of the aluminum surface after completion of the conversion treatment of the type according to the present invention (according to Table 1). Table 6 accordingly shows how, at a constant content of free fluoride, the morphology of the aluminum surface changes with an increasing concentration of zirconium. Without zirconium in the bath solution, the formation of lamellar phosphate crystals with an elevated aspect ratio is found without a continuous crystalline phosphate layer being present. Such a coating as the final product of a one-step conversion treatment is utterly unsuitable for adequate anticorrosion protection and a component treated in this manner would have to be subjected to post-passivation. However, the addition of just 10 ppm zirconium results in suppression of phosphating. No phosphate crystals or isolated "crystal clusters" are discernible on the surface, such that in the event of adequate passivation by the formation of an amorphous zirconium-based conversion layer, the object underlying the present invention is achieved in its entirety. This is, however, only the case if conditions prevail under which phosphating of steel and/or galvanized steel surfaces can take place.

TABLE 6

Scanning electron microscope (SEM) micrographs of conversion-treated aluminum sheets (AC120) at a content of free fluoride in the aqueous composition according to the invention of 55 ppm

Figure 2:
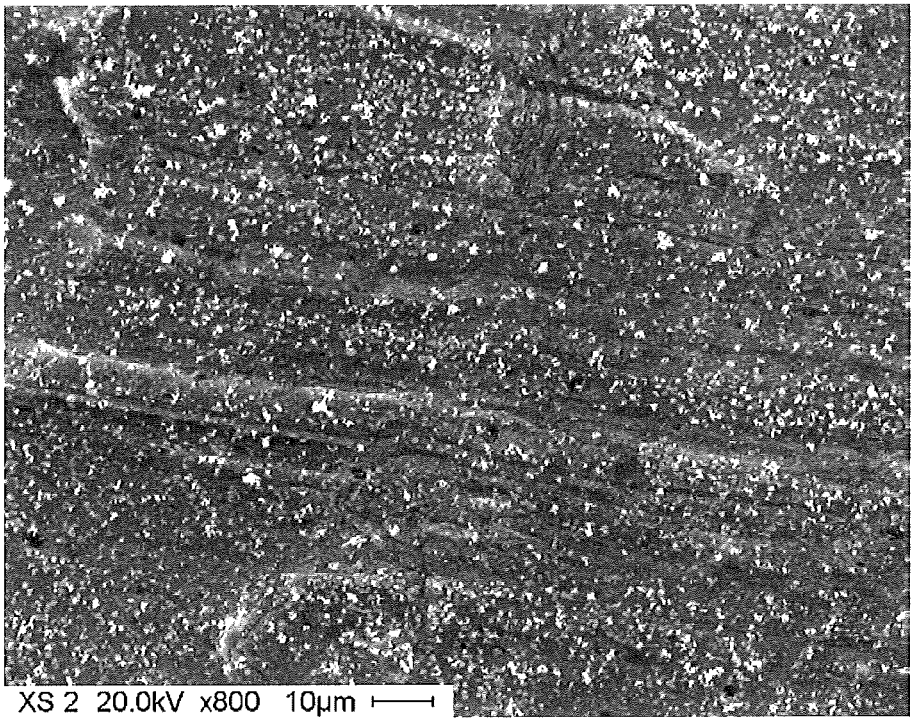
FIG. 2 shows a scanning electron microscope (SEM) micrograph of an aluminum sheet (AC120) conversion-treated in the aqueous composition according to the invention at a content of free fluoride of 55 ppm, a zirconium content of 10 ppm and a λ value of 8.7.
Figure 3:
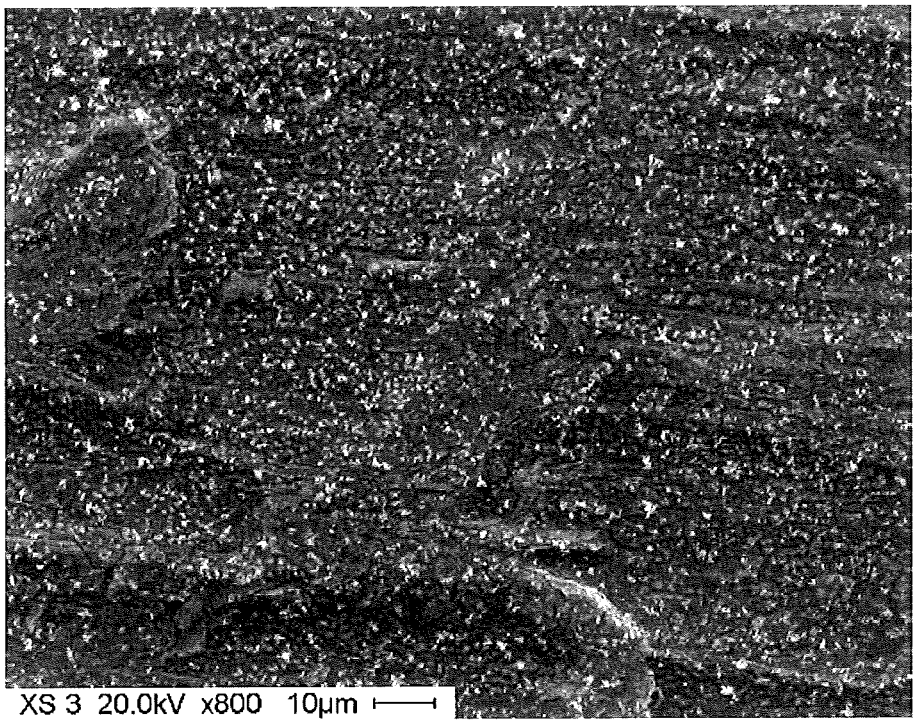
FIG. 3 shows a scanning electron microscope (SEM) micrograph of an aluminum sheet (AC120) conversion-treated in the aqueous composition according to the invention at a content of free fluoride of 55 ppm, a zirconium content of 20 ppm and a λ value of 5.6.

| Comparative | Sample 1 | Sample 2 |
|---|---|---|
| Zirconium: 0 ppm<br>λ value: not defined<br>LW: 3.00 g/m$^2$<br>Zr: <1.5 mg/m$^2$<br>Appearance is shown in FIG. 1 | Zirconium: 10 ppm<br>λ value: 8.7<br>LW: 0.40 g/m$^2$<br>Zr: 12.0 mg/m$^2$<br>Appearance is shown in FIG. 2 | Zirconium: 20 ppm<br>λ value: 5.6<br>LW: 0.40 g/m$^2$<br>Zr: 27.9 mg/m$^2$<br>Appearance is shown in FIG. 3 |

LW: layer weight in g/m$^2$ determined by differential weighing of the substrate conversion-treated according to Table 1 relative to the substrate after removal of the conversion layer in aqueous 65 wt. % $HNO_3$ at 25° C. for 15 min
Zr: zirconium loading in mg/m$^2$ determined by X-ray fluorescence analysis (XFA)

λ values for Table 6 are calculated as follows:
Sample 1:

$$\lambda = \frac{55\ \text{mg}\ F^-/\text{liter} \times (1\ \text{millimole}\ F^-/\text{MW}\ F^-\ \text{in mg})}{\sqrt{(10\ \text{mg Zr/liter} \times (1\ \text{millimole Zr/MW Zr in mg}))}} = 8.7$$

The influence of systematically varying the zirconium and/or titanium concentration with the free fluoride concentration in the aqueous treatment solution on the formation of the conversion layer for the various substrates aluminum (AC 120), CRS ST1405 (Sidca-Stahl) and HDG (Thyssen) is described below.

For the purposes of conversion treatment, using method steps identical to those in Table 1, the metal sheet in question is cleaned, rinsed, activated and then brought into contact with an aqueous treatment solution according to the invention corresponding to Table 1, but which contains either a) 0-70 ppm zirconium in the form of $H_2ZrF_6$ or
b) 0-70 ppm titanium in the form of $K_2TiF_6$ or
c) in each case 0-30 ppm zirconium and titanium in the form of $H_2ZrF_6$ and $K_2TiF_6$.

Tables 7 to 9 contain, as a function of the quotient λ of the treatment solutions a) to c) used in each case, a visual assessment of the phosphating on cold-rolled steel, since the formation of a continuous and uniform zinc phosphate layer is critical on this substrate in particular. For the purposes of visual assessment, the metal test sheet is subdivided into a grid of lines in such a manner that each approx. 1 cm$^2$ square field is individually assessed. The mean of the degrees of coverage added together from all the individual fields then provides a semi-quantitative measure of the overall degree of coverage of the particular metal sheet with the phosphate layer in percent of the investigated metal sheet area, said area consisting of at least 64 individual fields. A skilled person can here distinguish between coated and uncoated zones on the basis of their differing reflectivity and/or color. Phosphated zones have a matt grey appearance on all metallic substrates, while uncoated zones have a metallic shine and passivated zones have a bluish to violet luster.

TABLE 7

Layer weights and visual assessment of the phosphate layer on CRS ST1405 (Sidca-Stahl) after conversion treatment according to Example 2a

| No. | Zr in ppm | Free fluoride# in ppm | λ value | Visual assessment* | LW in g/m$^2$ |
|---|---|---|---|---|---|
| 1 | 0 | 23 | — | F: 10/B: 10 | 3.6 |
| 2 | 5 | 23 | 5.1 | F: 10/B: 10 | 3.3 |
| 3 | 10 | 22 | 3.5 | F: 1/B: 1 | — |
| 4 | 6 | 22 | 4.5 | F: 10/B: 10 | 3.7 |
| 5 | 10 | 22 | 3.5 | F: 0/B: 0 | — |
| 6 | 10 | 30 | 4.7 | F: 10/B: 9 | 3.7 |
| 7 | 10 | 45 | 7.1 | F: 10/B: 10 | 3.4 |
| 8 | 15 | 45 | 5.8 | F: 10/B: 10 | 3.6 |
| 9 | 30 | 43 | 3.9 | F: 1/B: 1 | — |
| 10 | 30 | 76 | 6.9 | F: 10/B: 10 | 3.2 |
| 11 | 50 | 75 | 5.3 | F: 10/B: 10 | 2.8 |
| 12 | 70 | 77 | 4.6 | F: 10/B: 9 | 2.9 |
| 13 | 70 | 90 | 5.4 | F: 10/B: 10 | 3.1 |

#measured with a fluoride-sensitive glass electrode in the cooled bath solution
*visual assessment on a scale from 0 to 10
10 corresponds to a 100% continuous crystalline phosphate layer
1 corresponds to a 10% continuous crystalline phosphate layer
0 corresponds to a pure passivation layer/no phosphating
F/B: front/back; the side of the metal sheet facing the stirrer and exposed to elevated bath movement is the front
LW: layer weight in g/m$^2$ determined by differential weighing after removal of the conversion layer in aqueous 5 wt. % $CrO_3$ at 70° C. for 15 min
λ value: $\lambda = F/mM/\sqrt{Zr/mM}$

TABLE 8

Layer weights and visual assessment of the phosphate layer on CRS ST1405 (Sidca-Stahl) after conversion treatment according to Example 2b

| No. | Ti in ppm | Free fluoride# in ppm | λ value | Visual assessment* | LW in g/m$^2$ |
|---|---|---|---|---|---|
| 1 | 0 | 25 | — | F: 10/B: 10 | 4.1 |
| 2 | 3 | 24 | 5.0 | F: 9/B: 8 | — |
| 3 | 3 | 28 | 5.8 | F: 10/B: 9 | 4.9 |
| 4 | 4 | 30 | 5.4 | F: 10/B: 9 | 4.7 |
| 5 | 4 | 42 | 7.6 | F: 10/B: 10 | 4.1 |
| 6 | 6 | 43 | 6.3 | F: 10/B: 8 | 4.6 |
| 7 | 6 | 74 | 10.9 | F: 10/B: 10 | 3.9 |
| 8 | 12 | 74 | 7.7 | F: 10/B: 10 | 4.0 |
| 9 | 14 | 100 | 9.6 | F: 10/B: 10 | 4.2 |
| 10 | 20 | 100 | 8.0 | F: 10/B: 10 | 3.8 |
| 11 | 30 | 102 | 6.7 | F: 9/B: 9 | — |
| 12 | 30 | 138 | 9.1 | F: 10/B: 10 | 3.7 |

TABLE 8-continued

Layer weights and visual assessment of the phosphate layer on CRS ST1405 (Sidca-Stahl) after conversion treatment according to Example 2b

| No. | Ti in ppm | Free fluoride# in ppm | λ value | Visual assessment* | LW in $g/m^2$ |
|---|---|---|---|---|---|
| 13 | 60 | 138 | 6.4 | F: 10/B: 9 | 4.1 |
| 14 | 70 | 138 | 5.9 | F: 9/B: 9 | 4.2 |

#measured with a fluoride-sensitive glass electrode in the cooled bath solution

*visual assessment on a scale from 0 to 10

10 corresponds to a 100% continuous crystalline phosphate layer 1 corresponds to a 10% continuous crystalline phosphate layer 0 corresponds to a pure passivation layer/no phosphating F/B: front/back; the side of the metal sheet facing the stirrer and exposed to elevated bath movement is the front LW: layer weight in $g/m^2$ determined by differential weighing after removal of the conversion layer in aqueous 5 wt. % $CrO_3$ at 70° C. for 15 min λ value: $\lambda = F/mM/\sqrt{Ti/mM}$

TABLE 9

Layer weights and visual assessment of the phosphate layer on CRS ST1405 (Sidca-Stahl) after conversion treatment according to Example 2c

| No. | Zr in ppm | Ti in ppm | Free fluoride* in ppm | λ value | Visual assessment | LW in $g/m^2$ |
|---|---|---|---|---|---|---|
| 1 | 0 | 0 | 20 | — | F: 10/B: 10 | 3.7 |
| 2 | 4 | 4 | 20 | 2.9 | F: 0/B: 0 | — |
| 3 | 4 | 4 | 30 | 4.4 | F: 9/B: 9 | 4.5 |
| 4 | 4 | 4 | 38 | 5.5 | F: 10/B: 10 | 4.1 |
| 5 | 8 | 8 | 40 | 4.1 | F: 0/B: 0 | — |
| 6 | 8 | 8 | 78 | 8.0 | F: 10/B: 10 | 4.0 |
| 7 | 12 | 12 | 78 | 6.5 | F: 10/B: 10 | 3.8 |
| 8 | 30 | 30 | 71 | 3.8 | F: 0/B: 0 | — |
| 9 | 30 | 30 | 95 | 5.0 | F: 10/B: 10 | 4.0 |
| 10 | 30 | 30 | 114 | 6.0 | F: 10/B: 10 | 3.9 |

#measured with a fluoride-sensitive glass electrode in the cooled bath solution

*visual assessment on a scale from 0 to 10

10 corresponds to a 100% continuous crystalline phosphate layer 1 corresponds to a 10% continuous crystalline phosphate layer 0 corresponds to a pure passivation layer/no phosphating F/B: front/back; the side of the metal sheet facing the stirrer and exposed to elevated bath movement is the front LW: layer weight in $g/m^2$ determined by differential weighing after removal of the conversion layer in aqueous 5 wt. % $CrO_3$ at 70° C. for 15 min λ value: $\lambda = F/mM/\sqrt{Zr/mM + Ti/mM}$

The invention claimed is:

1. A method for the anticorrosion conversion treatment of metallic surfaces which, in addition to surfaces of steel and/or galvanized steel and/or alloy-galvanized steel, also comprise surfaces of aluminum, comprising:

contacting cleaned and degreased metallic surfaces with an aqueous acidic composition comprising:

(a) 5-50 g/l phosphate ions;

(b) 0.3-3 g/l zinc(II) ions;

(c) one or more water-soluble compounds of zirconium present in an amount of 5-70 ppm, relative to elemental zirconium; and (d) 22-90 ppm of free fluoride;

and having a quotient λ corresponding to formula (I):

$$\lambda = \frac{F/mM}{\sqrt{Me/mM}} \quad (I)$$

F/mM and Me/mM respectively denoting the free fluoride (F) concentration in mM and zirconium concentration (Me) in mM, in each case divided by unit of concentration of mM, said quotient λ being at least 4, but no more than 7.1;

thereby forming an uninterrupted crystalline phosphate coating layer on the steel, galvanized steel and alloy-galvanized steel surfaces and a noncrystalline conversion coating layer on the aluminum surfaces.

2. The method as claimed in claim 1, wherein the aqueous composition exhibits a free acid content of no more than 3 points and a total acid content of no more than 26 points.

3. The method as claimed in claim 1, wherein said composition additionally contains at least one accelerator selected from:

0.3 to 4 g/l of chlorate ions;

0.01 to 0.2 g/l of nitrite ions;

0.05 to 4 g/l of nitroguanidine;

0.05 to 4 g/l of N-methylmorpholine N-oxide;

0.2 to 2 g/l of m-nitrobenzenesulfonate ions;

0.05 to 2 g/l of m-nitrobenzoate ions;

0.05 to 2 g/l of p-nitrophenol;

1 to 150 mg/l of hydrogen peroxide in free or bound form;

0.1 to 10 g/l of hydroxylamine in free or bound form; and 0.1 to 10 g/l of a reducing sugar.

4. The method as claimed in claim 1, wherein said composition additionally contains one or more cations selected from:

0.001 to 4 g/l of manganese(II);

0.001 to 4 g/l of nickel(II);

0.001 to 4 g/l of cobalt(II);

0.002 to 0.2 g/l of copper(II);

0.2 to 2.5 g/l of magnesium(II);

0.2 to 2.5 g/l of calcium(II);

0.01 to 0.5 g/l of iron(II);

0.2 to 1.5 g/l of lithium(I); and 0.02 to 0.8 g/l of tungsten(VI).

5. The method as claimed in claim 2, wherein the aqueous composition exhibits a free acid content of 0 points, but no more than 2 points and the total acid content amounts to at least 20 points, but no more than 24 points.

6. The method as claimed in claim 1, wherein the aqueous composition exhibits a pH value of no less than 2.2, but no greater than 3.8.

7. The method as claimed in claim 1, wherein the crystalline phosphate coating layer has an elemental loading of 0.5-4.5 $g/m^2$.

8. The method as claimed in claim 1, wherein the metallic surfaces comprising said phosphate coating layer and/or said conversion coating layer are, in a further method step with or without intermediate rinsing with water, coated with an electro-dipcoating.

9. The method as claimed in claim 1, wherein passivating post-rinsing is not carried out once the metallic surfaces have been brought into contact with the aqueous composition.

10. The method as claimed in claim 1, wherein passivating post-rinsing, with or without intermediate rinsing with water, takes place once the metallic surfaces have been brought into contact with the aqueous composition.

11. The method as claimed in claim 10, wherein the passivating post-rinsing exhibits a pH value in a range from 3.5 to 5.5 and contains in total 200 to 1500 ppm of fluoro complexes of zirconium and/or titanium relative to the elements zirconium and/or titanium and optionally 10 to 100 ppm of copper (II) ions.

12. The method as claimed in claim 1, wherein temperature of the aqueous composition is maintained in a range from 20 to 65° C. and said aqueous composition exhibits a free acid content of 0 points, but no more than 3 points, and a total acid content of at least 20 points, but no more than 26 points, and the zirconium (c) is present in an amount of 22-45 ppm.

13. The method as claimed in claim 1, wherein said contacting is followed by:

passivating post-rinsing said metallic surfaces, with or without intermediate rinsing with water, with a passivating post-rinse containing in total 200 to 1500 ppm of fluoro complexes of zirconium and/or titanium relative to the elements zirconium and/or titanium and optionally 10 to 100 ppm of copper(II) ions, the passivating post-rinse exhibiting a pH value in the range from 3.5 to 5.5, and coating said metallic surfaces, with or without intermediate rinsing with water, with an electro-dipcoating.

14. The method as claimed in claim 1, wherein said contacting is followed by coating said metallic surfaces, with or without intermediate rinsing with water, with an electro-dipcoating, but without a passivating post-rinsing step after said contacting.

* * * * *